US005395268A

United States Patent [19]

Okada

[11] Patent Number: 5,395,268

[45] Date of Patent: Mar. 7, 1995

[54] MODULAR JACK

[75] Inventor: Masanobu Okada, Nagaokakyo, Japan

[73] Assignee: Murata Mfg. Co., Ltd., Kyoto, Japan

[21] Appl. No.: 96,042

[22] Filed: Jul. 22, 1993

[30] Foreign Application Priority Data

Jul. 30, 1992 [JP] Japan ..... 4-203309

[51] Int. Cl.[6] ..... H01R 23/02

[52] U.S. Cl. ..... 439/676; 439/352

[58] Field of Search ..... 439/344, 676, 352, 353, 439/357, 358, 374

[56] References Cited

U.S. PATENT DOCUMENTS

| | | | |
|---|---|---|---|
| 4,969,836 | 11/1990 | Magnier et al. | 439/347 |
| 5,118,311 | 6/1992 | Margini | 439/676 |
| 5,183,404 | 2/1993 | Aldous et al. . | |
| 5,224,868 | 7/1993 | Tseng | 439/676 |

OTHER PUBLICATIONS

NEC PC-9801N-C01-UM.

*Primary Examiner*—David L. Pirlot
*Attorney, Agent, or Firm*—Spensley Horn Jubas & Lubitz

[57] ABSTRACT

A modular jack which is made thin. A hole is pierced in a flat member and a box member is disposed at an opening on one side of the hole. A modular plug is inserted through an opening opposite to the opening where the box member is located. At that time, the insertion direction is regulated by the inner walls of the hole or the inner walls of the box member, push is stopped by a bottom portion of the box member, return is stopped by a hook portion located near the opening through which the modular plug is inserted, and an electrode section is electrically connected to the modular plug. Springs enable only one action to be required.

13 Claims, 10 Drawing Sheets

MODULAR JACK

BACKGROUND OF THE INVENTION

1. Field of the Invention

This invention relates to techniques for disposing a modular jack at a place where there is a limitation on thickness. The techniques are used for IC cards, etc.

2. Description of the Related Art

Modular jacks and modular connectors have spread as means for connecting devices such as telephones and facsimile devices to telephone lines. FIG. 9 shows the structure of an IC card provided with a modular jack.

A modular jack 12 is located at one end of an IC card 10 shown in FIG. 9. The modular jack 12 is a jack into which a modular plug 14 can be inserted. On the other hand, telephone-related circuitry such as a modem (not shown) is arranged in the IC card 10. That is, the flat-packaged telephone-related circuitry is implemented as the IC card 10. The modular jack 12 is connected to the circuitry in the IC card 10. Therefore, the devices such as the modem incorporated in the IC card 10 can be connected to a telephone line or the like by attaching the modular plug 14 to the modular jack 12. If the IC card 10 is mounted in information processing equipment such as a personal computer, the information processing equipment can be connected to a telephone line.

FIG. 10 is a perspective view of the modular plug 14. FIGS. 11A and 11B each show the form of the modular jack 12. Particularly, FIG. 11A is a front view of the modular jack 12 and FIG. 11B is a sectional view taken on line A—A of FIG. 11A.

The modular jack 12 has the following basic functions:

The first function is an electric connection function to the modular plug 14, provided by an electrode section 24 located in the modular jack 12. When the modular plug 14 is inserted in the modular jack 12, the electrode section 24 is electrically connected to electrodes of the modular plug 14.

The second function is a function of regulating the insertion direction of the modular plug 14 to one direction, provided by inner walls 16 of the modular jack 12. That is, the modular plug 14 is guided by the inner walls 16 of the jack.

The third function is a function of stopping "push" of the modular plug 14, provided by a bottom portion 18. When the tip of the modular plug 14 abuts against the bottom portion 18, more specifically, against the electrode section 24 on the bottom portion 18, the modular plug 14 stops with its electrodes being in good contact with the electrode section 24.

The fourth function is a function of stopping "spring back" of the modular plug 14, provided by a hook portion 22 engaged with a lever 20 of the modular plug 14. Unless the lever 20 is pressed, the modular plug 14 cannot be drawn out of the modular jack 12 without destruction.

However, it is difficult to use the modular jack having the structure at a place or assembly where there is a limitation on thickness. To mount the modular jack 12 on an assembly whose thickness is limited like the IC card 10, one end of the IC card 10 must be made thicker than other portions as shown in FIG. 9. If such a structure is adopted, the form becomes complicated, complicating the production process and increasing costs.

SUMMARY OF THE INVENTION

Accordingly, it is a first object of the invention to provide a thin modular jack that can be used even with a place or assembly where there is a limitation on thickness.

It is a second object of the invention to make a flat assembly such as an IC card flatter by using such a modular jack.

It is a third object of the invention to suppress the possibility that a modular jack will be damaged.

It is a fourth object of the invention to enable a modular jack to be automatically housed when a modular plug is not connected to the modular jack.

To these ends, according to the invention, there is provided a modular jack comprising:

(a) a flat member having a hole pierced in the flat member in its thickness direction so that a modular plug can be inserted; the hole including:

(a1) first and second openings on surfaces of the flat member; the second opening being opposite to the first opening and the modular plug being inserted through the first opening;

(a2) a regulating member intervening between the first and second openings for regulating the insertion direction of the modular plug;

(a3) an electrode section disposed near the regulating member; the electrode section being connected to electrodes of the modular plug with the modular plug inserted up to a predetermined position from the first opening; and (a4) a hook member located near the first opening and near the regulating member for locking the modular plug with the modular plug inserted up to the predetermined position from the first opening, thereby preventing the modular plug from returning in the direction of the first opening; and (b) a box member which is pushed by the modular plug and whose part projects from the second opening when the modular plug is inserted up to the predetermined position from the first opening, the box member for regulating push of the modular plug along the insertion direction so as to hold the modular plug at the predetermined position in conjunction with the hook member.

To use the modular jack of the invention, first a modular plug is inserted into the hole Of the flat member. The regulating member such as an inner wall of the hole regulates the insertion direction of the modular plug. As the modular plug is inserted into the hole of the flat member while the insertion direction is being regulated, a part of the box member projects from the second opening. The box member stops "push" of the modular plug in the insertion direction; on the other hand, the hook member stops "spring back" or return of the modular plug. Thus, the modular plug is held at the predetermined position. At the position, electric connection to the modular plug can be made by the electrode section disposed within the hole.

Therefore, the invention can provide a modular jack which is thinner and flatter than the former modular connectors and thus is also applicable without thickening a part of a place or assembly whose thickness is limited. To install the modular jack at a thin place or assembly such as an IC card, a part of it need not be thickened. As a result, modular connectors whose form or structure is simplified and made flat can be easily produced at reduced costs.

The electrode section may be installed so that one end thereof projects from the inner wall and is then bend towards bottom of the box member and the opposite end pierces through the inner wall for electric connection to a circuit substrate. Preferably, spring material should be adopted for the electrode section. The flat member is covered with case plates such as metal plates so that said first and second openings open to the outside. The hook member has a form engaged with a lever of the modular plug.

Preferably, the box member has a structure which enables the box member to be housed in the flat member when the modular jack is not used. For example, the inner wall of the hole is formed with projections or the like for regulating the position of the box member with respect to the flat member. Specifically, it is preferable that one projection is provided corresponding to the state in which a modular plug is inserted into the hole to the predetermined position and another corresponding to the state in which no modular plug is inserted in the hole.

Further, preferably, the box member can be automatically housed in the flat member when the modular jack is not used. For example, spring means is installed for energizing the box member in the direction of the first opening from the second opening. When a modular plug is inserted in the hole, the spring means brings the electrodes of the modular plug into close contact with the electrode section and when the modular plug removed from the hole, the spring means automatically houses the box member in the hole. Thus, when the modular plug is inserted into and removed from the modular jack, operation as in the conventional example needs be performed; operability is therefore not impaired.

DESCRIPTION OF THE PREFERRED EMBODIMENTS

Figures 1A, 1B:
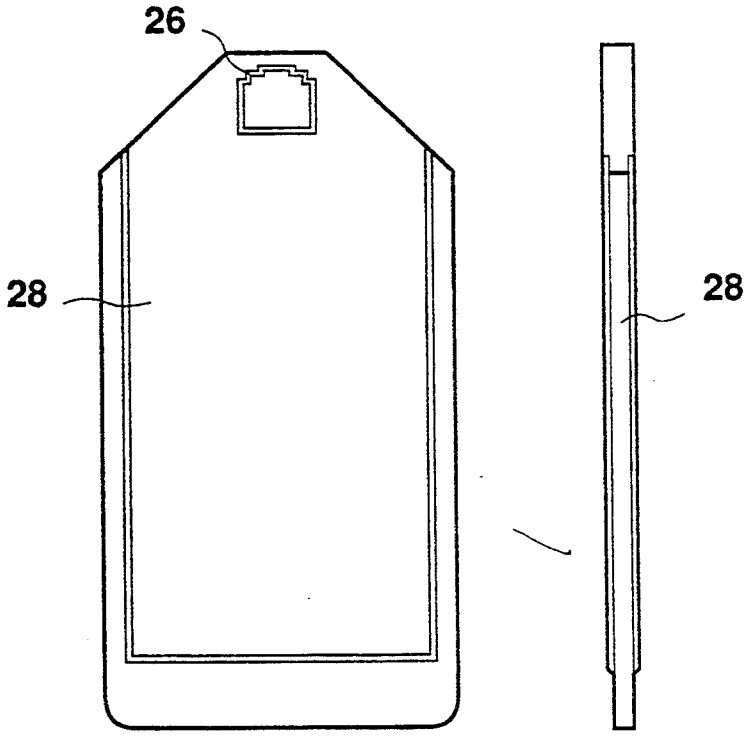
FIG. 1A is a drawing showing a use form of a modular jack of the invention, and is a top view of an IC card.
FIG. 1B is a drawing showing a use form of the modular jack of the invention, and is a side view of the IC card.

Referring now to the accompanying drawings, there are shown preferred embodiments of the invention. Parts identical with or similar to those previously described with reference to FIGS. 9 to 11B are denoted by the same reference numerals in FIGS. 2 to 8, and will therefore not be discussed again.

Figure 2:
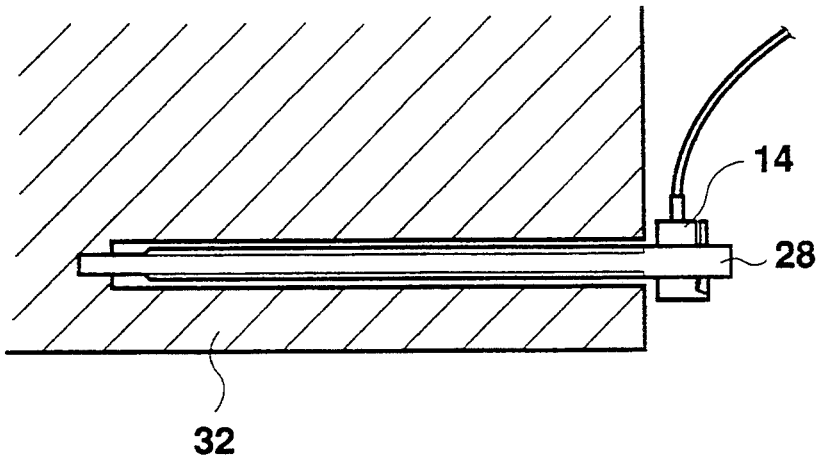
FIG. 2 is a sectional view showing the state in which the IC card shown in FIGS. 1A and 1B is installed in external equipment such as a personal computer and further a modular plug is connected to the IC card.

FIGS. 1A and 1B show one application example of a modular jack according to the invention. In FIGS. 1A and 1B, the modular jack 26 of the invention is disposed at one end of a flat IC card 28 and the one end has tapered sides which taper toward a rear edge of card 28. FIG. 2 shows how the IC card 28 is installed for use.

As shown in FIG. 2, the IC card 28 is installed in an external apparatus such as a personal computer or a wordprocessor for use. In the IC card 28, circuitry such as a modem (not shown) is installed. Therefore, the circuitry such as a modem is connected to the external apparatus 32 by installing the IC card 28 in the external apparatus 32. Also, it can be connected to a telephone line or the like by inserting a modular plug 14 into the modular jack 26. In FIG. 2, since the IC card 28 is connected to the external apparatus 32 and the modular plug 14 is inserted into the modular jack 26, the external apparatus 32 can communicate with an external system on a telephone line.

As shown in FIG. 2, to attach the modular plug 14, one end of the IC card 28 must project from the external apparatus 32. The IC card 28 is formed like a leaf as shown in FIG. 1A because it is necessary to provide a projection for attachment of the modular plug. However, the form of a flat assembly using the modular jack 26 of the invention is not limited to the leaf type form.

Figure 9:
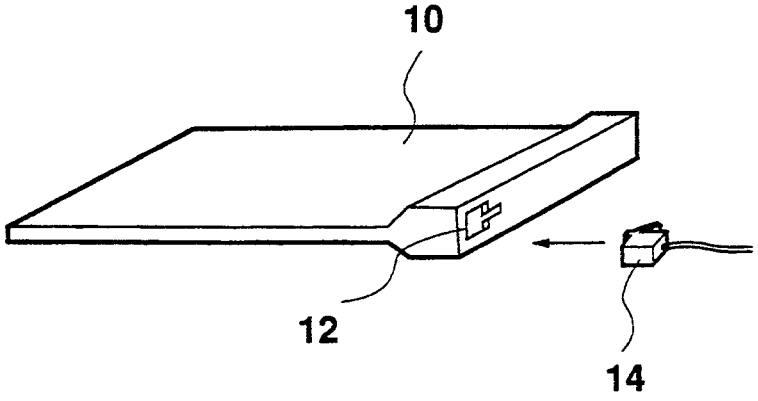
Fig. 9 PRIOR ART
FIG. 9 is a perspective view showing the structure of an IC card according to a conventional example.
Figure 10:
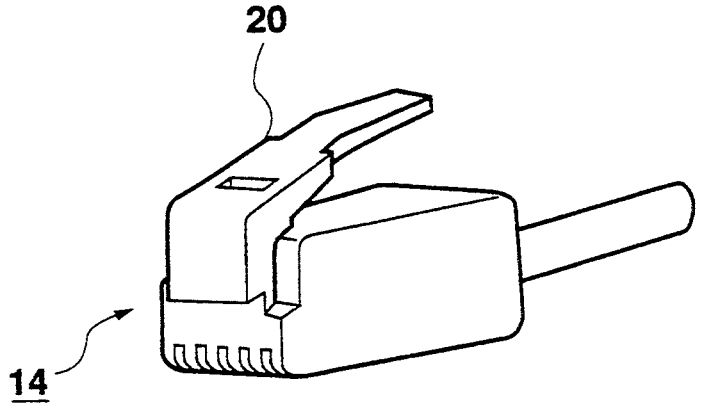
Fig. 10 PRIOR ART
FIG. 10 is a perspective view showing a form of a modular plug that can be attached to the IC card in FIG. 9.
Figure 11A:
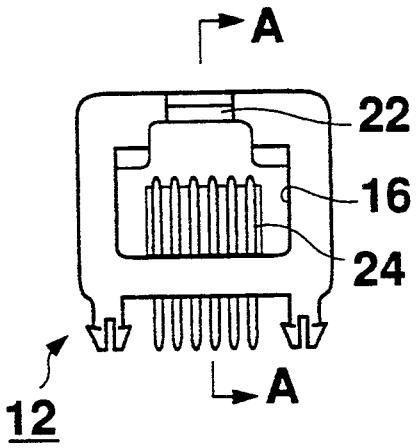
Fig. 11A PRIOR ART
FIG. 11A is a front view showing a form of a modular jack used with the IC card in FIG. 9.
Figure 11B:
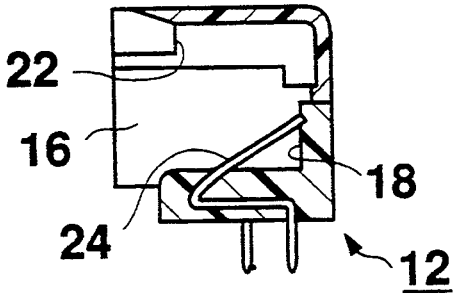
Fig. 11B PRIOR ART
FIG. 11B is a sectional view taken on line A—A of FIG. 11A.

Unlike the IC card 10 in FIG. 9, the IC card 28 has a substantially uniform thickness all over. That is, an increase in thickness at one end as shown in FIG. 9 does not occur. Such thickness design is enabled by making the thickness of the modular jack 26 of the invention substantially the same as that of the IC card 28. When the modular jack 26 of the invention is not used, it is housed in the IC card 28; when used, a part of the modular jack 26 is drawn out in the thickness direction of the IC card 28.

FIGS. 3A to 5 show the structure of a modular jack according to a first embodiment of the invention. The thin modular jack 26 shown in FIGS. 1 and 2 can be provided, for example, by the structure of the first embodiment shown in FIGS. 3A to 5. In the description to follow, the same reference numerals as in FIGS. 1A to 2 are used.

Figure 3A:
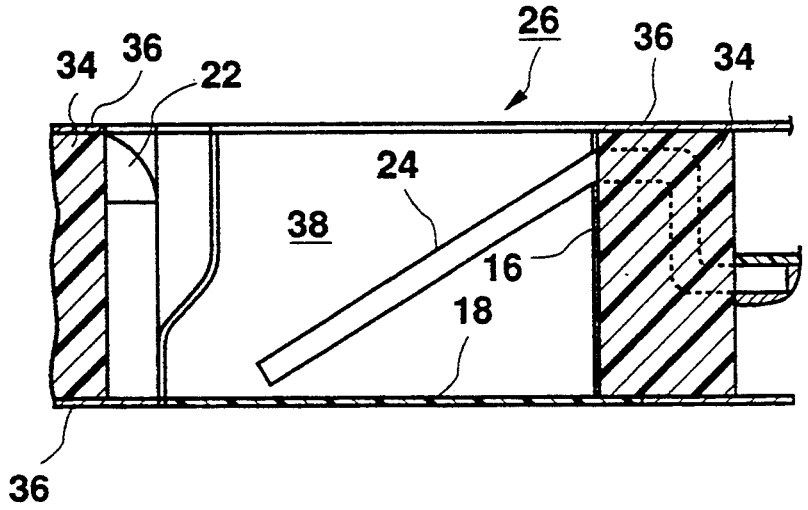
FIG. 3A is a sectional view in the electrode extension direction showing the structure of a modular jack according to a first embodiment of the invention and particularly showing the state in which a modular plug is not attached to the modular jack.
Figure 3B:
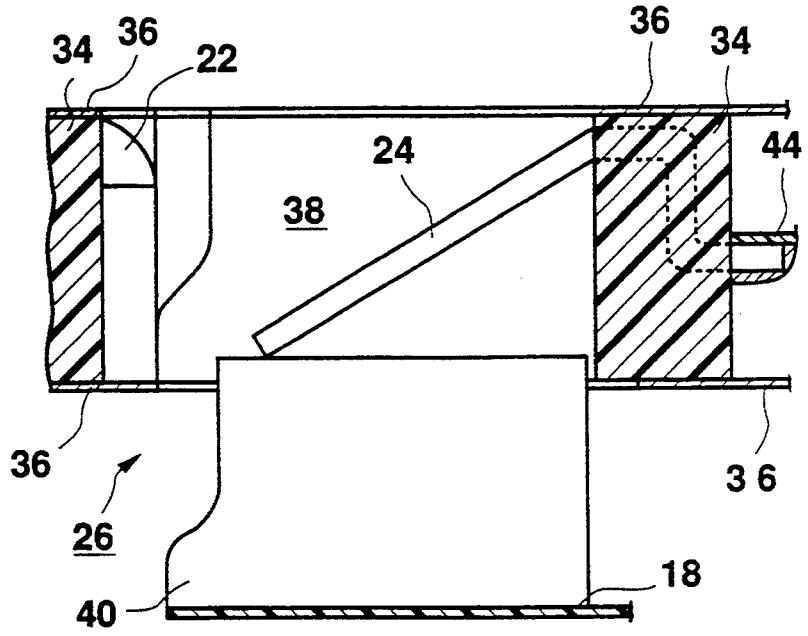
FIG. 3B is a sectional view in the electrode extension direction showing the structure of the modular jack according to the first embodiment of the invention in FIG. 3A and particularly showing the state in which a box is drawn out.
Figure 4A:
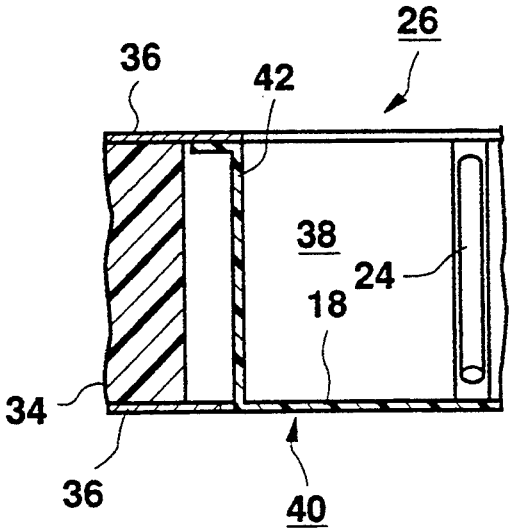
FIG. 4A is a sectional view in the direction perpendicular to electrodes showing the structure of the modular jack according to the first embodiment of the invention in FIG. 3A and particularly showing the state in which a modular plug is not attached to the modular jack.
Figure 4B:
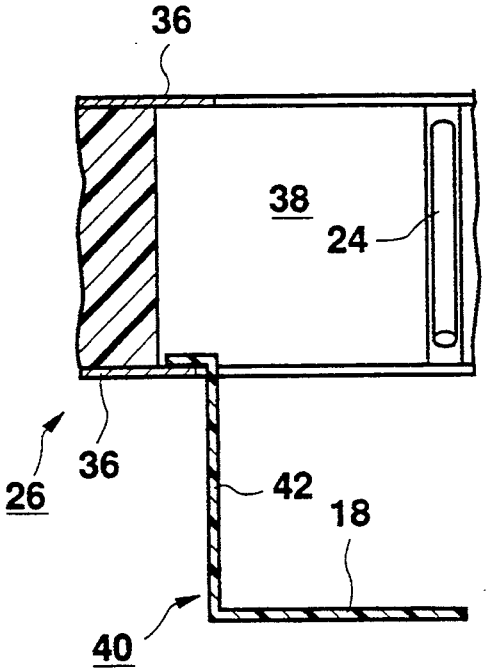
FIG. 4B is a sectional view in the direction perpendicular to electrodes showing the structure of the modular jack according to the first embodiment of the invention in FIG. 3A and particularly showing the state in which a box is drawn out.
Figure 5:
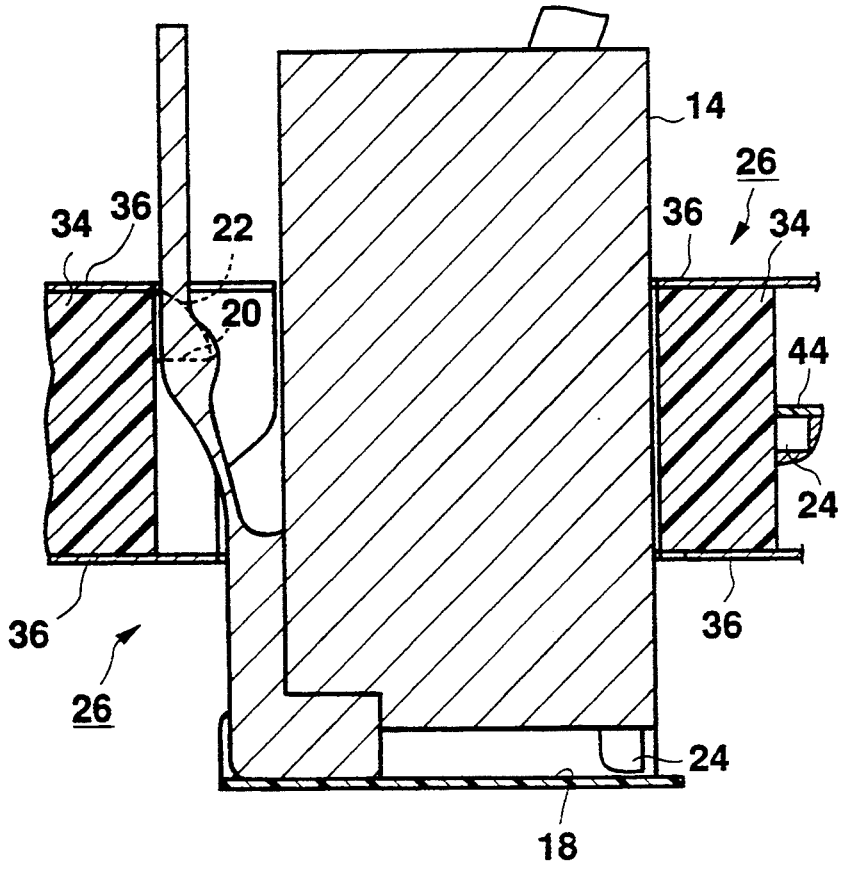
FIG. 5 is a sectional view in the electrode extension direction showing the state in which a modular plug is attached to the modular jack according to the first embodiment of the invention in FIG. 3A.

First, FIGS. 3A and 4A show the state in which a modular plug 14 is not attached to the modular jack 26; particularly, FIG. 3A is a sectional view in the extension direction of an electrode section 24 and FIG. 4A is a sectional view in the direction perpendicular to the electrode section 24. FIGS. 3B and 4B show the state in which a box according to a feature of the first embodiment is drawn out; particularly, FIG. 3B is a sectional view in the extension direction of the electrode section 24 and FIG. 4B is a sectional view in the direction perpendicular to the electrode section 24. FIG. 5 is a sectional view in the extension direction of the electrode section 24 with the modular plug 14 inserted in the modular jack 26.

As shown in the figures, the modular jack 26,according to the embodiment is formed in a part of a flat member 34. A case of the IC card 28 consists of the metal plates 36 which cover the front and back of the flat member 34. That is, the modular jack 26 according to the embodiment is integral with the IC card 28 in the case.

In the flat member 34, a hole 88 is formed so that the modular plug 14 can be inserted. When the modular plug 14 is inserted from one opening of the hole 38, inner walls 16 of the hole 38 and inner walls 42 of the box 40 regulate the insertion direction of the modular plug 14. The box 40 is disposed at another opening of the hole 38 and the bottom portion 18 of the box 40 has a function of stopping the insertion push direction of the modular plug 14. A hook portion 22 located near the opening on the opposite side to the box 40 is engaged with a lever 20 of the modular plug 14 to provide a function of stopping the insertion spring back direction of the modular plug 14. The electrode section 24, which is disposed in the hole 38, is in contact with electrodes of the modular plug 14. The electrode section 24 pierces through the flat member 34 and is soldered onto a substrate 44 in the IC card 28. Therefore, when the modular plug 14 is inserted, the internal circuitry of the IC card 28 and the modular plug 14 are electrically connected to each other.

In the embodiment, the box 40 is disposed at the opening of the flat member 34 to form the modular jack 26. Therefore, the modular plug 14 can be connected without thickening a part of an assembly or the like whose thickness is limited like the IC card 28. Thus, the IC card 28 which has a uniform thickness and is easily manufactured a compared with former IC cards can be provided. An equivalent effect can be produced at a place or on an assembly whose thickness is limited in addition to the IC card 28.

Figure 6A:
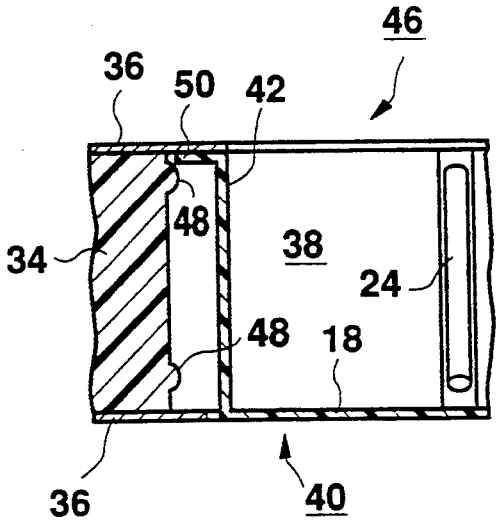
FIG. 6A is a sectional view in the direction perpendicular to electrodes showing the structure of a modular jack according to a second embodiment of the invention and particularly showing the state in which a modular plug is not attached to the modular jack.
Figure 6B:
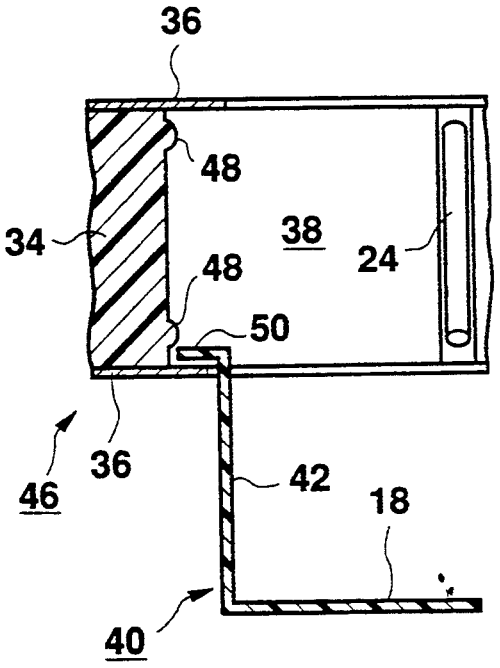
FIG. 6B is a sectional view in the direction perpendicular to electrodes showing the structure of the modular jack according to the second embodiment of the invention in FIG. A and particularly showing the state in which a box is drawn out.

FIGS. 6A and 6B show the structure of a modular jack 46 according to a second embodiment of the invention. Like FIGS. 4A and 4B, FIGS. 6A and 6B each represent a sectional view in the direction perpendicular to an electrode section 24.

The second embodiment is characterized by forming projections 48 in a portion of the inner walls of a hole 38 of a flat member 34 opposite to the inner walls 42 of a box 40. The projections 48 are formed so as to regulate the position of an edge portion 50 extended from the inner walls 42 near either of the openings of the hole 38.

In the first embodiment, particularly as shown in FIGS. 4A and 4B, the position of the box 40 in the vertical direction is not regulated when the modular plug 14 is not mounted. In the second embodiment, the projections 48 regulate the position of the box 40 in the vertical direction, thereby properly preventing the box 40 from being damaged. When a modular plug 14 is not connected to the modular jack 46, by pushing the box 40 in the upper direction of FIGS. 6A and 6B to position the box 40 as shown in FIG. 6A, the box 40 does not project beyond the bottom of IC card 28, thus the box 40 can be properly prevented from being damaged due to impact, etc.

Figure 7A:
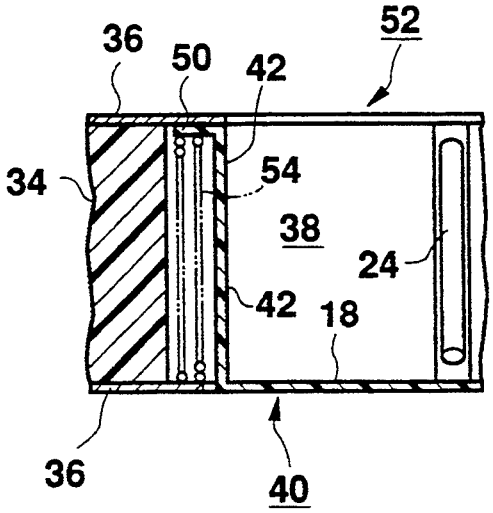
FIG. 7A is a sectional view in the direction perpendicular to electrodes showing the structure of a modular jack according to a third embodiment of the invention and particularly showing the state in which a modular plug is not attached to the modular jack.
Figure 7B:
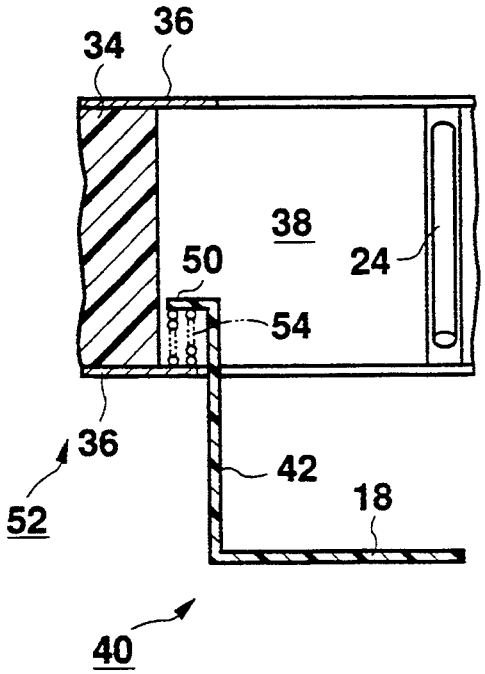
FIG. 7B is a sectional view in the direction perpendicular to electrodes showing the structure of the modular jack according to the third embodiment of the invention in FIG. 7A and particularly showing the state in which a box is drawn out.

FIGS. 7A and 7B show the structure of a modular jack 52 according to a third embodiment of the invention. The third embodiment is characterized by installing springs 54 for a box 40. The springs 54, which are located between an edge portion 50 and a lower metal plate 36, bias the box 40 so that it is housed in a hole 38 as shown in FIG. 7A when a modular plug 14 is not inserted in the hole 38. Therefore, in the embodiment, when the modular plug 14 is inserted into the hole 38, a stop on a bottom portion 18 properly works by force of the springs 54. When the modular plug 14 is taken out from the hole 38, the box 40 is automatically restored to the inside of the hole 38 by force of the springs 54. As a result, the modular plug 14 can be inserted and removed by easy operation as in the conventional example, namely, by one action.

Figure 8A:
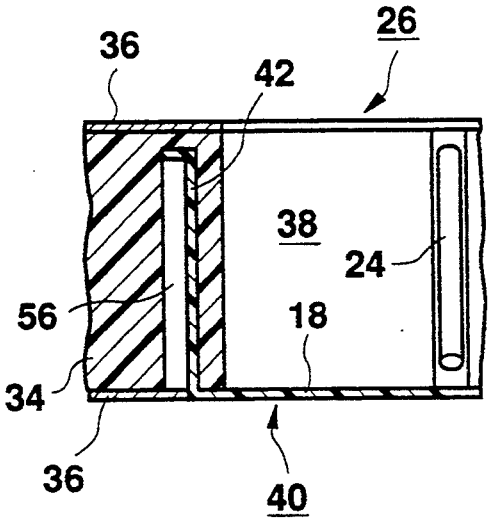
FIG. 8A is a sectional view in the direction perpendicular to electrodes showing the structure of a modular jack according to a fourth embodiment of the invention and particularly showing the state in which a modular plug is not attached to the modular jack.
Figure 8B:
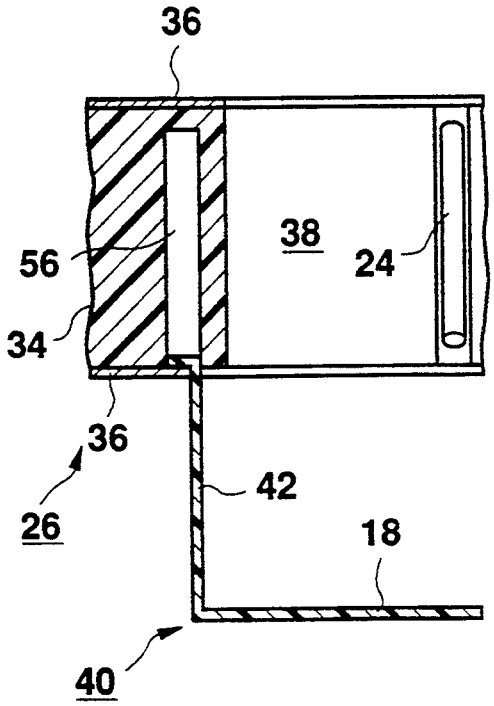
FIG. 8B is a sectional view in the direction perpendicular to electrodes showing the structure of the modular jack according to the fourth embodiment of the invention in FIG. 8A and particularly showing the state in which a box is drawn out.

If an inner wall 42 of a box 40 is housed in a slit 56 of a flat member 34 as shown in FIG. 8, the insertion direction of a modular plug 14 can be regulated without using the inner walls 42 of the box 40.

As described above, according to the invention, a box is disposed at an opening on one side of a hole formed in a flat member and a regulating member such as the inner walls of the flat member and the box make up a modular jack. Thus, when the modular jack is installed at a thin place or assembly like an IC card, a portion thereof need not be thickened. As a result, a modular jack whose form or structure is simplified and made flat can be easily produced at reduced costs.

Further, according to the invention, springs are installed to restore the box to the inside of the hole of the flat member, thereby improving operability.

What is claimed is:

1. A modular jack for receiving a modular plug, said modular jack comprising:

a) a flat member having first and second opposed major surfaces and having a hole pierced in said flat member and extending between said opposed major surfaces so that said hole has first and second openings each at a respective one of said first and second major surfaces, the modular plug being insertable into the hole by movement in an insertion direction through said first opening, said flat member having guide surfaces in said hole for guiding insertion movement of the modular plug;

b) an electrode section disposed in said hole for contact with electrodes of the modular plug when the modular plug is inserted in said hole to a predetermined position relative to said first opening;

c) a hook member located near said first opening for locking the modular plug in place relative to said modular jack when the modular plug is inserted to the predetermined position, thereby preventing movement of the modular plug from the predetermined position in a direction opposite to the insertion direction; and d) an open-top box member supported by said flat member and having a bottom surface which extends across said hole and is oriented transverse to the insertion direction, said box member being movable in translation relative to said flat member to an end position in which the modular plug bears against said bottom surface when the modular plug is in the predetermined position so that said hook member and said box member cooperate to retain an inserted modular plug in the predetermined position.

2. The modular jack as claimed in claim 1 wherein said electrode section projects from an inner wall of said hole and is bent towards the bottom surface of said box member.

3. The modular jack as claimed in claim 1 wherein said electrode section pierces through an inner wall of said hole and is electrically connected to a circuit substrate.

4. The modular jack as claimed in claim 1 wherein said hook member is configured to engage with a lever of the modular plug.

5. The modular jack as claimed in claim 1 further including a part for regulating the end position of said box member with respect to said flat member when the modular plug is inserted up to said predetermined position from said first opening.

6. The modular jack as claimed in claim 1 further including a part for regulating a position of said box member with respect to said flat member when the modular plug is not inserted in said hole.

7. The modular jack as claimed in claim 1 further including spring means for biasing said box member in the direction of said first opening from said second opening; when the modular plug is taken out from said hole, said spring means being operative for automatically housing said box member in said hole.

8. A modular jack as defined in claim 1 wherein said bottom surface of said box member has two opposed edges and said box member comprises two side walls each of which extends from a respective edge of said bottom surface and which are guided by said flat member for movement in the insertion direction, said side walls presenting additional guide surfaces for guiding insertion of the modular plug.

9. The modular jack as claimed in claim 1 wherein said flat member has an end which terminates at a rear edge and has tapered sides which terminate at said rear edge, and said hole is located at said end, between said tapered sides.

10. The modular jack as claimed in claim 1 wherein said hole extends perpendicularly to said opposed major surfaces of said flat member so that said first and second openings are aligned with one another in the direction perpendicular to said opposed major surfaces.

11. A modular jack as defined in claim 1 wherein said first and second opposed major surfaces of said flat member enclose a region and said box member is movable to place said bottom surface outside of said region when said box member is in said end position.

12. The modular jack as claimed in claim 1 wherein said flat member is covered with case plates so that said first and second openings open to the outside.

13. The modular jack as claimed in claim 12 wherein said case plates are metal plates.

* * * * *